US005651643A

United States Patent [19]

Haul et al.

[11] Patent Number: 5,651,643

[45] Date of Patent: Jul. 29, 1997

[54] APPARATUS FOR TRANSPORTING SECTIONS OF FILTER RODS

[75] Inventors: Michael Haul, Hamburg; Rolf Petersen, Gülzow, both of Germany

[73] Assignee: Hauni Maschinenbau AG, Hamburg, Germany

[21] Appl. No.: 511,522

[22] Filed: Aug. 4, 1995

[30] Foreign Application Priority Data

Sep. 2, 1994 [DE] Germany ..... 44 31 273.3

[51] Int. Cl.[6] ..... B65G 51/02

[52] U.S. Cl. ..... 406/3; 406/11; 406/31; 406/82

[58] Field of Search ..... 406/3, 10, 11, 406/31, 82, 83; 198/457, 367

[56] References Cited

U.S. PATENT DOCUMENTS

| | | | |
|---|---|---|---|
| 3,222,110 | 12/1965 | Kelly et al. | 406/82 |
| 3,608,972 | 9/1971 | Rudszinat | 198/457 |
| 4,368,742 | 1/1983 | Wahle et al. | 406/82 |
| 4,551,040 | 11/1985 | Kasparek et al. | 406/10 |
| 4,618,293 | 10/1986 | Heitmann | 406/83 |

FOREIGN PATENT DOCUMENTS

| | | | |
|---|---|---|---|
| 811811 | 7/1949 | Germany | 198/457 |
| 34 17 483 A1 | 11/1984 | Germany . | |
| 2140479 | 11/1984 | United Kingdom | 406/83 |
| 2272414 | 5/1994 | United Kingdom | 406/11 |

*Primary Examiner*—Gary C. Hoge
*Attorney, Agent, or Firm*—Darby & Darby

[57] ABSTRACT

Apparatus for conveying filter rod sections from storage or from a maker to a reservoir or to a filter tipping machine for cigarettes or other rod-shaped articles of the tobacco processing industry has a first conveyor which advances the filter rod sections lengthwise, a second conveyor which advances the sections sideways, and a unit which transfers successive sections of a series of sections delivered by the first conveyor to the second conveyor. The advancement of sections by the first conveyor is interrupted if the spacing between successive sections in the first conveyor is less than required for disturbance-free transfer of sections from the first conveyor into the second conveyor. One or more sensors are provided to minitor the movements of sections at the transfer unit and to generate signals which are utilized to remove sections from the transfer unit when the pattern of movement of sections from the first conveyor to the second conveyor departs from a desired pattern.

22 Claims, 3 Drawing Sheets

APPARATUS FOR TRANSPORTING SECTIONS OF FILTER RODS

BACKGROUND OF THE INVENTION

The invention relates to improvements in apparatus for transporting rod-shaped articles of the tobacco processing industry, such as sections of filter rods which are to be assembled with plain cigarettes, cigars or other tobacco containing rod-shaped products to jointly form filter cigarettes, cigars or other filter-tipped rod-shaped smokers' products.

The following description will refer, either continuously or primarily, to rod-shaped articles which constitute filter rod sections; however, it is to be understood that the apparatus of the present invention can be utilized with equal or similar advantage for the transport of other types of rod-shaped articles of the tobacco processing industry.

As a rule, or at least in many instances, filter rod sections are transported longitudinally from a source, such as one or more filter making machines, by one or more first conveyors, normally pneumatic conveyors which subject successive sections of a long series of such sections to the action of a compressed gaseous fluid (such as air) in order to propel the sections of the series through shorter or longer distances to a transfer station where the nature of advancement of successive sections is changed from longitudinal to sidewise movement. The conveyor or conveyors which are utilized to advance the filter rod sections sideways (i.e., transversely of their length) can be used to deliver the sections to a magazine forming part of a filter tipping machine, to a reservoir or to any other destination. Similar apparatus are or can be utilized for the transport of filter rod sections from a first reservoir to one or more second reservoirs or from a first reservoir into the magazine or magazines of one or more filter tipping machines.

The equipment at the transfer station should be capable of changing the direction of advancement of filter rod sections from longitudinal to transverse without affecting the appearance and/or other desirable characteristics of the sections. Moreover, the change of the direction of advancement must be carried out at a very high frequency in order to meet the requirements of modern high-speed filter tipping and/or other machines which are used to store and/or process filter rod sections. It is necessary to uniformize the series of sections which advance toward the transfer station as well as to provide between successive sections of the series gaps or spaces wide or long enough to ensure that each preceding section can be transferred from a first path in which it is caused to move longitudinally into a second path wherein it is caused to move sideways without any obstruction by the immediately following section. This is important because, in heretofore known machines, any clogging of and/or other malfunction at the transfer station can entail huge losses in output due to the need to interrupt the operation of the entire apparatus in order to manually remove all damaged sections and to restore the operativeness of the equipment at the transfer station. Moreover, any prolonged stoppage of the transporting apparatus evidently necessitates stoppage(s) of machine(s) receiving filter rod sections from such apparatus.

OBJECTS OF THE INVENTION

An object of the invention is to provide an improved apparatus which can transport filter rod sections or other rod-shaped articles of the tobacco processing industry more reliably than and at least at the same rate as heretofore known apparatus.

Another object of the invention is to provide the apparatus with novel and improved means for reducing the likelihood of clogging of the transfer station between a first conveyor which moves the articles lengthwise and a second conveyor which moves the articles sideways.

A further object of the invention is to provide an apparatus which is designed to ensure early and preferably instantaneous detection of malfunctions of at least one of the conveyors.

An additional object of the invention is to provide an apparatus which is designed to ensure early and preferably instantaneous detection of malfunctions at the transfer station.

Still another object of the invention is to provide an apparatus which can automatically eliminate the causes of malfunction of at least one of the conveyors.

A further object of the invention is to provide an apparatus which can automatically eliminate the cause or causes of malfunction at the transfer station between the first and second conveyors and which can eliminate such cause or causes of malfunction within short intervals of time.

Another object of the invention is to provide a novel and improved method of transporting rod-shaped articles of the tobacco processing industry along a composite path wherein the orientation of articles changes on their way from the inlet to the outlet of the composite path.

SUMMARY OF THE INVENTION

The invention is embodied in an apparatus for transporting elongated rod-shaped articles of the tobacco processing industry, for example, rod-shaped (unit length or multiple unit length) filters for tobacco smoke. The improved apparatus comprises a fluid-operated (such as pneumatic) first conveyor having means for advancing successive articles of a series of articles longitudinally along a first path, a second conveyor (e.g., a mechanical conveyor) for advancing articles along a second path wherein the articles move transversely of their length, means for transferring successive articles of the series from the first path into the second path in accordance with a predetermined pattern (at the very least, such pattern ensures that each preceding article of the series is not interfered with by the immediately following article during transfer from the first path into the second path), means for monitoring the transferring means and for generating signals denoting eventual departures of the transfer of articles from the predetermined pattern, and signal processing control means connected with the monitoring means.

At least one of the paths is or can be an at least substantially horizontal path.

The transferring means preferably includes a guide (e.g., a lever-shaped member) for successive articles which are advanced by the first conveyor. The guide is or can be designed in such a way that it has an open side confronting the second conveyor, and the transferring means employing such guide preferably further comprises means (e.g., a cam or ramp) for deflecting successive articles advancing longitudinally of the guide sideways through the open side of the guide and into the second conveyor. The guide is preferably mounted in such a way that it is movable between a first position in which the articles advancing along the guide are directed into the range of (e.g., directly against) the deflecting means and at least one second position in which the guide establishes at least one outlet for articles having been advanced by the first conveyor so that the articles which enter the outlet cannot reach the deflecting means. The guide can be mounted in such a way that it is pivotable in and counter to the direction of advancement of articles by the second conveyor. The apparatus wherein the transferring means utilizes the aforementioned guide preferably further comprises means (e.g., a fluid-operated motor) for moving the guide from the first position to the at least one second position in response to signals which are generated by the monitoring means and are processed and thereupon transmitted to the moving means by the aforementioned control means. The means for moving the guide is preferably designed to move the guide from the at least one second position back to the first position upon termination of transmission of processed signals from the control means. The arrangement is preferably such that the means for moving the guide is operative to automatically return the guide to its first position in response to termination of the transmission of processed signals from the control means.

The second conveyor can comprise at least one conveying element (e.g., a pair of endless belts and/or a pair of driven rollers) which is arranged to be driven in a predetermined direction to advance the articles away from the transferring means, and in a second direction at least substantially counter to the predetermined direction. Such second conveyor preferably further comprises means for driving the at least one conveying element in the predetermined direction in the absence of signal generation by the monitoring means, and in the second direction in response to signals which are generated by the monitoring means and are processed and transmitted to the driving means by the control means.

The advancing means of the first conveyor can comprise at least one conveying element (e.g., one or more pairs of rollers) arranged to be driven to advance articles along the first path toward the transferring means, and the apparatus can further comprise means for arresting the at least one conveying element in response to transmission of processed signals from the control means.

The apparatus can further comprise one or more brakes for articles in the first path and means for activating the brake or brakes—to thus automatically interrupt the advancement of articles toward the transferring means—in response to transmission of processed signals by the control means.

The monitoring means can comprise at least one opto-electrical sensor or transducer and/or one or more proximity detectors and/or any other suitable means for inspecting the operation of the transferring means and for generating signals in response to detection that the pattern of transfer of articles from the first path into the second path departs from the predetermined (optimum) mode or pattern.

As already mentioned hereinbefore, successive articles of the series of articles are separated from each other by clearances or gaps or spaces during advancement along the first path, at least during advancement along that portion of the first path which is adjacent to (e.g., immediately upstream of) the transferring means. Such apparatus preferably further comprises means for ascertaining the length of spaces between successive articles of the series (e.g., in the aforementioned portion of the first path) and for transmitting to the control means second signals in response to detection of spaces having a length below a predetermined length (as seen in the direction of advancement of articles along the first path). The apparatus preferably further comprises means for removing from the first path articles immediately following those spaces the length of which is below the predetermined length, and such removal takes place in response to processed second signals transmitted to the removing means by the control means. The removing means can comprise means for pneumatically expelling articles from the first path, e.g., by resorting to one or more nozzles designed to discharge one or more jets or blasts or streams of compressed air.

Still further, the apparatus can comprise means for evacuating articles from the first path in response to processed signals which are generated by the monitoring means and/or by the length ascertaining means. Such evacuating merans can comprise one or more pneumatically operated evacuating devices.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
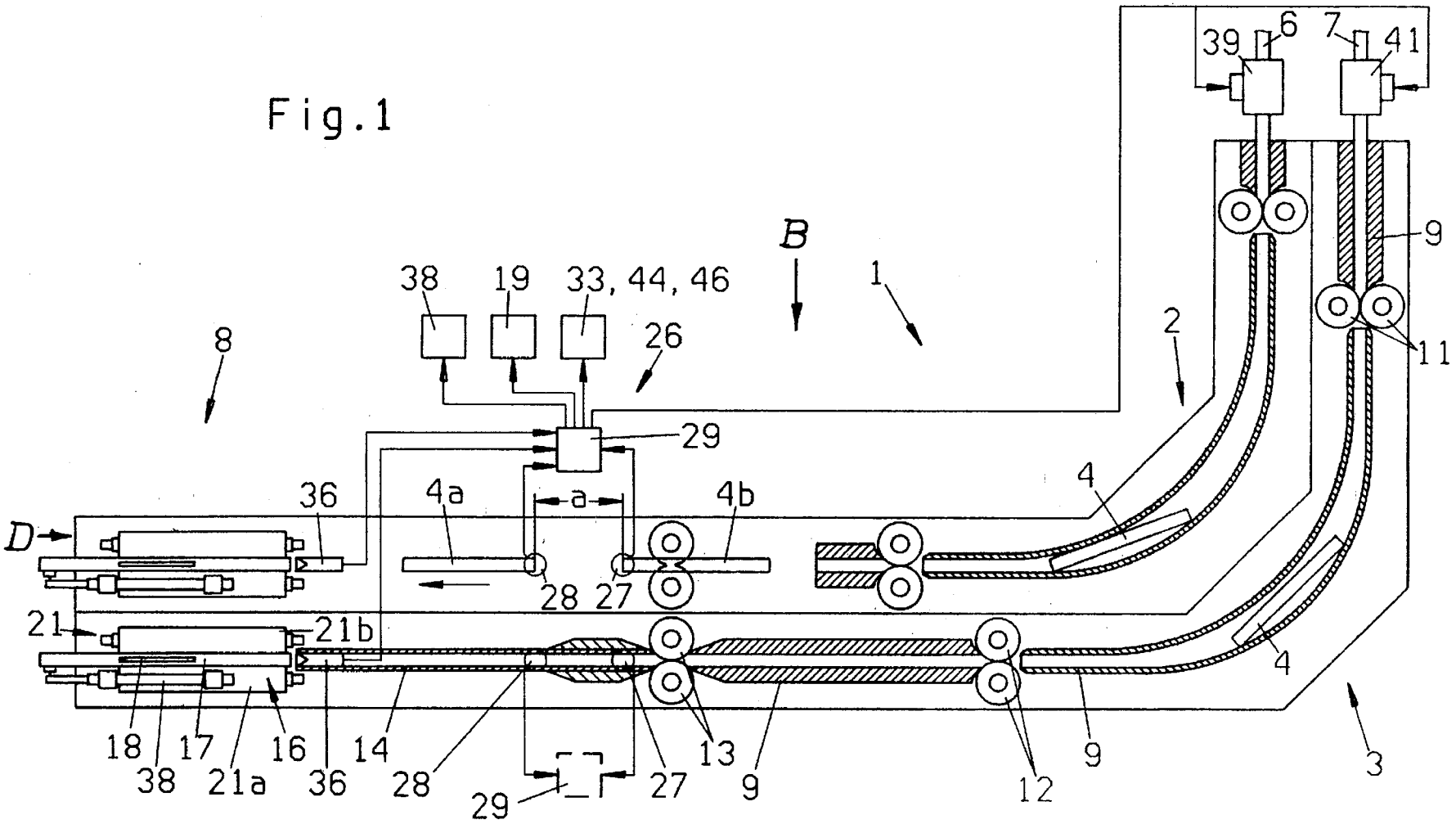
FIG. 1 is a fragmentary partly schematic and partly vertical sectional view of an apparatus which embodies one form of the present invention.
Figure 2:
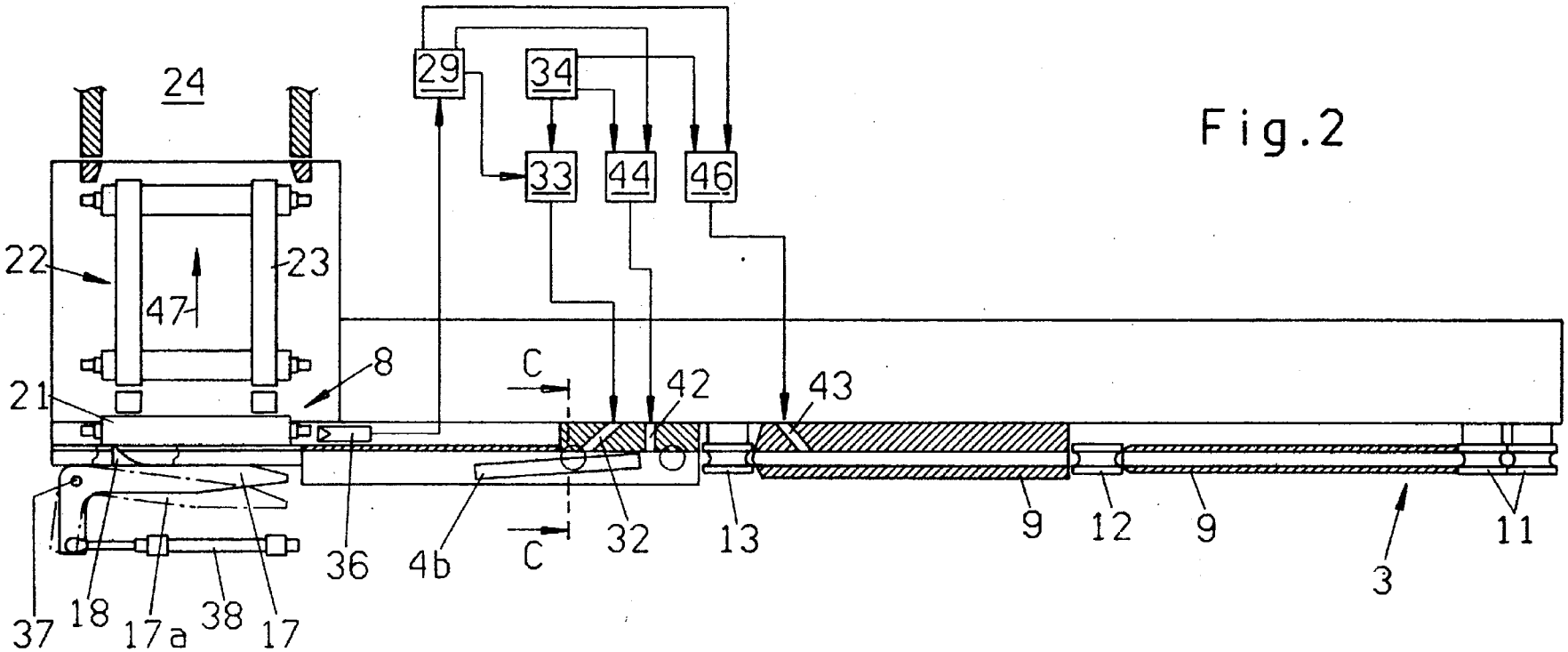
FIG. 2 is a partially plan and partially substantially horizontal sectional view of the apparatus as seen in the direction of arrow B in FIG. 1.

Referring to FIGS. 1 and 2, there is shown a dual or twin apparatus 1 for transporting two series of elongated rod-shaped articles 4 of unit length or multiple unit length. The articles 4 can constitute filter rod sections which are being transported from a reservoir (not shown), from a single maker (such as the one disclosed in U.S. Pat. No. 3,974,007 granted Aug. 10, 1976 to Heinz Greve for "Method and apparatus for the production of filter rod sections or the like"), or from a plurality of makers to at least one tipping machine wherein the filter rod sections are assembled with tobacco-containing rod sections to form therewith filter cigarettes, filter cigarillos or other rod-shaped articles of the tobacco processing industry.

Each individual apparatus of the twin apparatus 1 comprises a first conveyor 2, 3 which is a fluid-operated (pneumatic) conveyor and serves to advance the sections 4 lengthwise in a direction toward a transferring unit 8 which, in turn, introduces successive sections 4 into one of two second conveyors 21 wherein the sections 4 are advanced sideways (arrow 47), i.e., transversely of their length to enter a magazine 24, e.g., a reservoir or the hopper or an analogous storage facility of a tipping machine.

The fluid-operated first conveyors 2 and 3 respectively comprise conduits 6, 7 wherein the sections 4 are propelled lengthwise by a compressed gaseous fluid (e.g., air) through normally open (idle) braking devices 39, 41 and into arcuate conduits 9 wherein the pneumatic propelling action is replaced or assisted by advancing means here shown as including three pairs of driven rollers 11, 12 and 13.

Since the construction of the first conveyor 2 is or can be identical with that of the first conveyor 3, only one of these conveyors will be described in full detail. The same holds true for the construction and the mode of operation of the two section transferring units 8 and of the two second conveyors 21.

The purpose of the pairs of rollers 11, 12 is to ensure that each section which advances beyond the respective pair of rollers 12 is caused to move longitudinally at a preselected speed. The rollers 13 accelerate successive sections 4 beyond the speed which was imparted to such sections by the rollers 12 to thus develop between successive sections clearances a of sufficient width to ensure that the transfer of a preceding section 4 from the first path defined by the conveyor 2 or 3 into the second path (arrow 47) defined by the respective second conveyor 21 is not interfered with by the immediately following section. A section 4 which has been propelled by the third pair of rollers 13 is caused to move through another path portion 14 which immediately precedes the respective transferring unit 8. The path portion 14 is followed by an additional path portion 16 which can be said to be within the confines of the respective transferring unit 8 and wherein successive sections continue to advance longitudinally or lengthwise or axially in a direction to the left, as viewed in FIGS. 1 and 2, partially within the confines of an elongated guide 17 which forms part of the respective unit 8 and cooperates with a deflector 18 in the form of a ramp or cam serving to expel successive sections 4 through an open side of the associated guide 17 and in the direction of the arrow 47, i.e., into the range of the respective second conveyor 21. The open side of the guide 17 faces toward the respective second conveyor 21.

Figure 4:
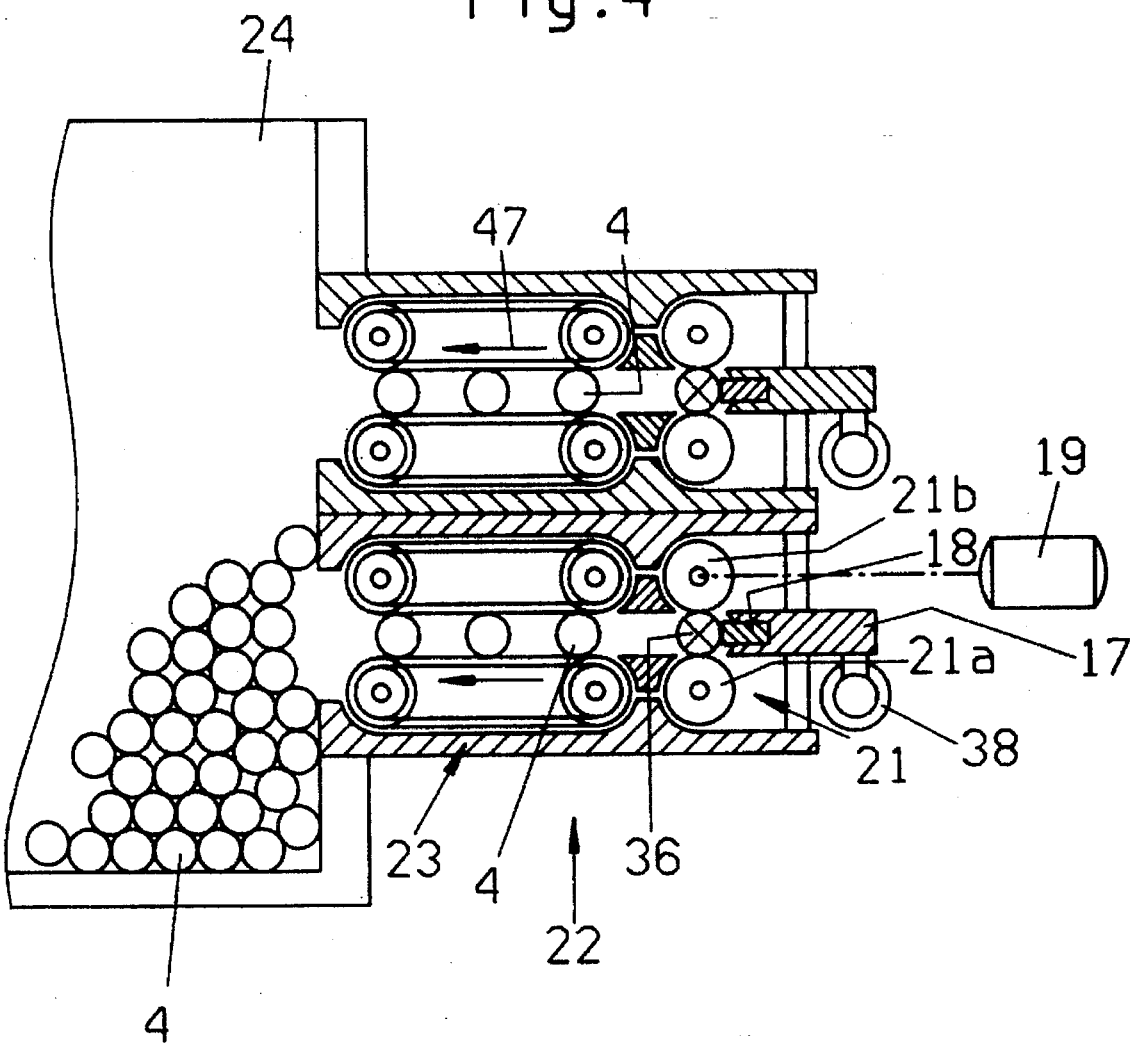
FIG. 4 is an enlarged partially sectional view substantially as seen in the direction of the arrow D in FIG. 1.

Each second conveyor 21 comprises a pair of rollers 21*a*, 21*b* (see also FIG. 4) whose axes are parallel to the direction of advancement of successive sections 4 along the path portion 16. The deflecting ramp or cam 18 of the respective unit 8 is positioned in such a way that it causes an oncoming section 4 to begin to move sideways and into the range of the respective rollers 21*a*, 21*b* which, in turn, propel successive sections 4 sideways between two pairs of endless belts 23 also forming part of the respective second conveyor 21. The reference character 22 denotes in FIG. 4 all of the conveying elements (21*a*, 21*b* and 23) forming part of the lower second conveyor 21. The second conveyors 21 deliver filter rod sections 4 sideways into the receptacle 24 which, as already mentioned above, can constitute a magazine in a filter tipping machine or a reservoir for a shorter- or longer-lasting storage of filter rod sections. The paths which are defined by the second conveyors 21 shown in FIG. 4 are at least substantially horizontal. On the other hand, the first paths defined by the first conveyors 2 and 3 can be in part horizontal and in part inclined or vertical, depending on the availability of space for the transport of filter rod sections 4 from one or more sources to one or more receptacles 24.

FIG. 2 shows only certain details of the first conveyor 3, of the corresponding transferring unit 8 and of the corresponding second conveyor 21. The construction and the mode of operation of the transferring unit 8 constitute highly important features of the improved apparatus because any departures of the actual mode of transferring sections 4 from that portion of the first path which is shown at 14 from a desired or optimal or predetermined pattern or mode can entail longer-lasting interruptions of delivery of sections from the first conveyor 3 into the receptacle 24 as well as loss of substantial numbers of sections 4, e.g., due to defacing and/or partial or even complete destruction.

One important factor which determines the mode of operation of a transferring unit 8 is the spacing or clearance or gap between each section 4 arriving into the respective guide 17 and the immediately following section 4. If such spacing a is below a predetermined value, the next-following section 4 is likely to interfere with sidewise diversion of the preceding section 4 by the respective deflecting device 18 through the open side of the guide 17 and into the range of the rollers 21*a*, 21*b* forming part of the respective second conveyor 21. The actual spacing a between successive sections 4 as well as certain other variable parameters which can influence the mode of operation of a transferring unit 8 are monitored, scanned and/or otherwise detected and evaluated by a composite regulating system 26 which comprises (a) two detectors 27, 28 which ascertain the length of successive spaces a downstream of the respective pair of rollers 13, (b) monitoring means 36 at the respective guide 17, and (c) a signal processing control circuit 29 having inputs for signals from the detectors 27, 28 and from the monitoring means 36.

The detectors 27, 28 can constitute optoelectrical sensors, and they transmit to the control circuit 29 signals when they detect the ends of the sections 4 advancing therealong in the first path defined by the respective conveyor 2 or 3. The control circuit 29 processes such signals in any well known manner to determine the length of successive spaces a. If the length of a space a is less than a predetermined minimum acceptable length, the circuit 29 transmits a defect signal which results in the ejection from the first path of that section (4*b* in FIG. 1) which immediately follows a section (4*a* in FIG. 1) preceding a space a of less than the predetermined mimimum length.

Figure 3:
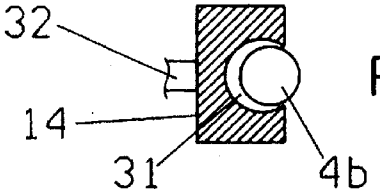
FIG. 3 is an enlarged vertical sectional view substantially as seen in the direction of arrows from the line C—C in FIG. 2.

The expulsion of filter rod sections (4*b*) following spaces a having a length less than the minimum acceptable length can take place, for example, in the first path at least slightly upstream of the respective transferring unit 8. FIG. 3 shows that the first conveyor 3 has a lateral opening or outlet 31 which can receive one or more jets or blasts or streams of a compressed gaseous fluid (such as air) from a port 32 machined into or otherwise formed in the conveyor 3 at the upstream end of the lateral opening 31. The port 32 can be connected to a suitable source 34 of compressed gaseous fluid by a valve 33 which receives processed signals from the corresponding output of the control circuit 29. Each of the aforementioned defect signals from the control circuit 29 entails an opening of the valve 33 so that the jet or jets of compressed fluid entering the lateral opening 31 of the conveyor 3 of FIG. 2 can expel the respective section 4*b* from the first path and into a collecting receptacle, not shown. This ensures that a section 4*b* cannot interfere with the deflection of the immediately preceding section 4*a* during advancement of the section 4*a* through the respective transferring unit 8 on its way into the corresponding second conveyor 21.

Monitoring of the lengths of spaces a between successive sections 4 in the first conveyors contributes significantly to reliability of the transfer of sections from the respective guides 17 into the respective second conveyors 21. Nevertheless, the sections 4 are still likely to be caught in the transferring units 8 and to cause the accumulations of a series of successive arriving sections which not only results in damage to such sections but also interrupts the advancement of sections into the receptacle 24. Thus, a lengthier interruption of delivery of sections 4 into the receptacle 24 could necessitate a stoppage of the machine or machines which receive articles from the receptacle 24. Modern filter tipping machines turn out huge quantities of filter cigarettes or like rod-shaped articles per unit of time so that any, even short lasting, interruption of operation invariably results in substantial losses in output.

It has been found that, even if the length of spaces a is entirely satisfactory, pronounced slowing down of articles passing through a transferring unit 8 is likely to interrupt the advancement of sections into the range of and within the respective second conveyor 21. Analogously, pronounced slowing down of articles 4 which have entered a second conveyor 21 or which were about to enter such second conveyor can also lead to pronounced departures from the desired mode or pattern of operation of a transferring unit 8 and/or a second conveyor 21. Any such disturbances which develop in a conventional apparatus necessitate a stoppage of the apparatus and tedious lengthy manual removal of sections which happen to come to a halt and/or to be damaged or destroyed at a transferring station and/or in a second conveyor.

The aforementioned monitoring device 36 at each of the transferring units 8 renders it possible to automatically compensate or correct for eventual deviations or departures of the transfer of articles 4 from the predetermined or desired or optimum pattern or mode. Each of the illustrated monitoring devices 36 can constitute an optoelectrical sensor which, as already mentioned before, is also connected to the respective control circuit 29. The latter processes the signals from the respective monitoring device 36 and transmits processed signals to a moving means 38 (such as a fluid-operated cylinder and piston assembly) for the corresponding guide 17. Each guide 17 is movable by the respective assembly 38 between a first or operative position (shown in FIG. 2 by solid lines) and a second or retracted position 17*a* (shown in FIG. 2 by phantom lines). The guides 17 of the illustrated transferring units 8 are pivotable (as at 37) between their first and second positions and FIG. 2 shows that such pivoting takes place toward or away from the respective second conveyor 21, i.e., in or counter to the direction indicated by the arrow 47.

FIG. 4 shows that the rollers 21*a*, 21*b* of the lower second conveyor 21 receive motion from a prime mover 19, e.g., a reversible electric motor. This motor also receives signals from the respective control circuit 29. The motor for the rollers of the upper second conveyor of FIG. 4 has been omitted for the sake of clarity.

If the mode of operation of the improved apparatus at one of the transferring units 8 departs from the desired mode or pattern, the respective monitoring device 36 transmits a signal to the corresponding control circuit 29. For example, a monitoring device 36 can detect an arrested filter rod section 4 or a section advancing at a speed less than the expected speed. Such deceleration of one or more sections 4 is particularly likely to occur in the range of the rollers 21*a*, 21*b* forming part of the respective second conveyor 21. The control circuit 29 generates a defect signal which is immediately transmitted to the prime mover(s), not shown, for the pairs of rollers 11, 12 in the corresponding first conveyor 2 or 3. The defect signal from the control circuit 29 further serves to immediately arrest the prime mover (not shown) for the respective accelerating rollers 13 in the first conveyor 2 or 3. This results in immediate interruption of the delivery of additional sections 4 into the respective transferring unit 8, i.e., into the path section 16 which is defined by the respective pivotable guide 17.

If considered necessary by the designer of the improved apparatus, the defect signal from the control circuit 29 (in response to a signal from the respective monitoring device 36) can further serve to effect the activation or actuation of the respective braking device 39 or 41. This ensures that no further sections 4 tend to enter that part of the first conveyor 2 or 3 which is actually shown in FIG. 1. Brakes for filter rod sections which can be utilized at 39 and/or 41 in FIG. 1 are disclosed, for example, in commonly owned German Pat. No. 34 17 483 A1.

The defect signal from one of the control circuits 29 can also be transmitted to a suitable display to facilitate detection of the malfunction by the attendant or attendants. Thus, the attendant or attendants are informed that no further sections 4 are being delivered into the respective transferring unit 8 and know that it is necessary to undertake certain corrective measures.

However, the preferred embodiment of the improved apparatus is designed in such a way that, in addition to or in lieu of displaying defect signals on a screen or the like, the apparatus automatically initiate and complete corrective measures in order to reestablish proper mode of operation in the region of the one or the other transferring unit 8.

To this end, a defect signal which is transmitted by the control circuit 29 in response to a defect signal which is generated by one of the monitoring devices 36 is used to pivot the respective guide 17 from the first position to the second position 17*a* by way of the corresponding cylinder and piston assembly 38. This enables the pivoted guide 17 to establish an outlet for evacuation of trapped sections 4 from the respective transferring unit 8, i.e., such sections can bypass the respective deflecting ramp or cam 18 and be expelled or evacuated from the apparatus. The deflecting ramp or wedge or cam 18 can share the movement of the adjacent guide 17 from a first or operative to a second or inoperative position. If the deflecting member 18 is movable between such positions, its second or inoperative position is selected in such a way that the member 18 is unlikely or even less likely to interfere with the expulsion of trapped section or sections 4 from the respective transferring unit 8 by way of the outlet or opening which is established by the guide 17 as soon as the latter reaches its second position 17*a*.

The defect signal from the control circuit 29 is further transmitted to the corresponding motor 19 which starts the respective rollers 21*a*, 21*b* in reverse so that these rollers then advance trapped sections 4 counter to the direction of the arrow 47 and from the apparatus through the outlet established by the guide 17 which is then maintained in the second position 17*a*. It has been found that the just described mode of expelling stuck sections 4 from a transferring unit 8 is effective even if one or more sections have undergone pronounced deformation and/or other damage at the rollers 21*a*, 21*b* of the respective second conveyor 21. Filter rod sections 4 are apt to be deformed during advancement along the path section 16 (i.e., within the respective open-sided guide 17), along the deflecting member 18 and into the range of the respective rollers 21*a*, 21*b*.

Each of the first conveyors 2, 3 is further equipped with means for evacuating sections 4 from the respective path. As shown in FIG. 2, such evacuating means comprises two pneumatically operated evacuating devices 42, 43 in the form of ports provided in the respective first conveyor and designed to transmit blasts of compressed gaseous fluid (such as air) which can expel articles 4 from the respective first path. The ports 42, 43 are respectively connected with the aforementioned source 34 of compressed gaseous fluid by valves 44 and 46 which are responsive to defect signals from the corresponding outputs of the control circuit 29. The ports 42, 43 effect the evacuation of articles 4 from the respective first path to thus ensure highly predictable entry of the leader of a series of successive articles 4 into the respective first path when the admission of articles 4 into such path is resumed.

When the evacuation of deformed or undeformed sections 4 from a transferring zone 8 is completed, the cylinder and piston assembly 38 automatically returns the corresponding guide 17 to its first or operative position so that the thus pivoted guide is ready to again direct sections 4 into the range of the respective deflecting member 18. Furthermore, the direction of operation of the motor 19 is automatically reversed so that this motor again drives the respective rollers 21*a*, 21*b* to advance successive sections 4 from the corresponding guide 17 into the space between the respective pairs of belt conveyors 23. The normal operation can be resumed as soon as the brake 39 or 41 is deactivated, i.e., as soon as the conduit 6 or 7 is again free to advance successive sections 4 of a series of such sections into the range of the corresponding rollers 11.

As can be seen on the basis of the preceding description of the mode of operation of the improved apparatus, the invention renders it possible to automatically resume the normal operation of a transferring unit 8 as soon as the evacuation of sections 4 which were arrested or clamped or gripped or deformed in such unit is reliably and predictably completed. The length ascertaining means 27, 28 cooperate with the monitoring means 36 to ensure that the control circuit 29 can generate defect signals which can reliably initiate all undertakings necessary to ensure rapid and predictable evacuation of sections 4 from the respective first path, to ensure the activation of the respective brake 39 or 41, to ensure the movement of the respective guide 17 to its second position, to ensure a reversal in the direction of operation of the respective motor 19, and to immediately reestablish the normal operating conditions as soon as the disturbance in the region of a transferring unit 8 is eliminated.

Those portions of the first paths which are denoted by the characters 9 are preferably closed, i.e., they need not be provided with lateral outlets, longitudinally extending slots or the like.

An important advantage of the improved apparatus is that it can immediately react to a number of different disturbances including a shortening of the spaces a below a predetermined minimum length and/or improper operation of a transferring unit 8 and/or a second conveyor 21. All this can be accomplished within an extremely short interval of time and the apparatus can automatically reset all of its constituents for normal operation as soon as the cause of malfunction at the one or the other transferring unit 8 is eliminated. Thus, it is no longer necessary to manually remove any filter rod sections 4 which happen to be caught in a transferring unit 8 because all necessary undertakings which must be carried out to restore the operability of a unit 8 can be carried out by the control circuit in cooperation with the respective monitoring device 36 and in cooperation with the respective length ascertaining means 27, 28. The provision of monitoring means 36 at each of the transferring stations 8 constitutes a novel feature which renders it possible to dispense with manual evacuation of filter rod sections 4 from a transferring unit 8. It is no longer necessary to interrupt the operation of the apparatus for prolonged intervals of time because not only the stoppage but also the restarting of the parts is effected automatically in response to signals from the length ascertaining means 27, 28 and/or from the monitoring means 36.

The deflecting members 18 at the transfer units 8 are particularly likely to undergo extensive wear as a result of repeated contact with the leading ends of successive sections 4 advancing along the respective guides 17. The pivotability of the guides 17 renders it possible to gain ready access to the respective deflecting members 18 for the purposes of inspection or replacement. This, too, contributes to longer useful life of the improved apparatus.

Another important advantage of the improved apparatus is its simplicity and its reliability. The regulating system is simple, reliable and inexpensive. Also, proper mounting of the guide 17 and of the deflecting member 18 at each of the transferring units 8 presents no problems and can be selected in dependency on the nature of the sections 4 or other rod-shaped articles which are to be conveyed to the receptacle 24 or to another destination.

Still another advantage of the improved apparatus is that the disturbances which are likely to develop as a result of the development of spaces a which are shorter than necessary for reliable operation of the transferring units 8 can be readily prevented even before they develop, i.e., by ascertaining the length of the spaces a before the corresponding sections 4*a* and 4*b* reach the respective transferring unit 8.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. Apparatus for transporting elongated rod-shaped articles of the tobacco processing industry, comprising a fluid-operated first conveyor having means for advancing successive articles of a series of articles longitudinally along a first path; a second conveyor for advancing articles along a second path wherein the articles move transversely of their length; means for transferring successive articles of the series from the first path into the second path in accordance with a predetermined pattern, including a guide for successive articles advanced by said first conveyor, said guide having an open side confronting said second conveyor and said means for transferring further comprising means for deflecting successive articles advancing longitudinally of said guide through said open side and into said second conveyor, said guide being movable between a first position in which the articles advancing therealong are directed into the range of said deflecting means and at least one second position in which said guide establishes an outlet for articles having been advanced by said first conveyor; means for monitoring the transferring means and for generating signals denoting eventual departures of the transfer of articles from the predetermined pattern; and signal processing control means connected with said monitoring means.

2. The apparatus of claim 1, wherein the articles include rod-shaped filters for tobacco smoke.

3. The apparatus of claim 1, wherein at least one of said paths is an at least substantially horizontal path.

4. The apparatus of claim 1, wherein said second conveyor is operative to advance the articles in a predetermined direction and said guide is pivotable in and counter to said predetermined direction.

5. The apparatus of claim 1, further comprising means for moving said guide from said first position to said at least one second position in response to signals generated by said monitoring means, and processed and transmitted by said control means.

6. The apparatus of claim 5, wherein said means for moving said guide is operative to move the guide from said at least one second position back to said first position upon termination of transmission of processed signals from said control means.

7. The apparatus of claim 5, wherein said means for moving said guide is operative to automatically return the guide to said first position in response to termination of transmission of processed signals from said control means.

8. The apparatus of claim 1, wherein said second conveyor comprises at least one conveying element arranged to be driven in a predetermined direction to advance articles away from said means for transferring and in a second direction at least substantially counter to said predetermined direction, and means for driving said at least one conveying element in said predetermined direction in the absence of signal generation by said monitoring means and in said second direction in response to signals generated by said monitoring means and processed and transmitted by said control means.

9. The apparatus of claim 1, wherein said advancing means of said first conveyor comprises at least one conveying element arranged to be driven to advance articles along said first path toward said means for transferring, and further comprising means for arresting said at least one conveying element in response to processed signals from said control means.

10. The apparatus of claim 1, further comprising at least one brake for articles in said first path and means for activating said at least one brake, to thus automatically interrupt the advancement of articles toward said means for transferring, in response to processed signals from said control means.

11. The apparatus of claim 1, wherein said monitoring means comprises at least one optoelectrical sensor.

12. The apparatus of claim 1, wherein said monitoring means comprises at least one proximity detector.

13. The apparatus of claim 1, wherein successive articles of the series are normally separated by spaces during advancement along said first path at least in a first path portion adjacent said means for transferring, and further comprising means for ascertaining the length of spaces between successive articles of the series in said portion of said first path and for transmitting to said control means second signals in response to detection of spaces having a length below a predetermined length.

14. The apparatus of claim 13, further comprising means for removing from said first path articles following spaces having a length less than said predetermined length in response to processed second signals from said control means.

15. The apparatus of claim 13, further comprising means for evacuating articles from said first path in response to processed signals generated by at least one of said monitoring means and said length ascertaining means.

16. Apparatus for transporting elongated rod-shaped articles of the tobacco processing industry, comprising a fluid-operated first conveyor having means for advancing successive articles of a series of articles longitudinally along a first path; a second conveyor for advancing articles along a second path wherein the articles move transversely of their length; means for transferring successive articles of the series from the first path into the second path in accordance with a predetermined pattern; means for monitoring the transferring means and for generating signals denoting eventual departures of the transfer of articles from the predetermined pattern; and signal processing control means connected with said monitoring means, said second conveyor comprising at least one conveying element arranged to be driven in a predetermined direction to advance articles away from said means for transferring and in a second direction at least substantially counter to said predetermined direction, and means for driving said at least one conveying element in said predetermined direction in the absence of signal generation by said monitoring means and in said second direction in response to signals generated by said monitoring means and processed and transmitted by said control means.

17. The apparatus of claim 16, wherein said means for transferring includes a guide for successive articles advanced by said first conveyor, said guide having an open side confronting said second conveyor and said means for transferring further comprising means for deflecting successive articles advancing longitudinally of said guide sideways through said open side and into said second conveyor.

18. The apparatus of claim 17, wherein said guide is movable between a first position in which the articles advancing therealong are directed into the range of said deflecting means and at least one second position in which said guide establishes an outlet for articles having been advanced by said first conveyor.

19. Apparatus for transporting elongated rod-shaped articles of the tobacco processing industry, comprising a fluid-operated first conveyor having means for advancing successive articles of the series of articles longitudinally along a first path; a second conveyor for advancing articles along a second path wherein the articles move transversely of their length; means for transferring successive articles of the series from the first path into the second path in accordance with a predetermined pattern, successive articles of the series being normally separated by spaces during advancement along said first path at least in a first path portion adjacent said means for transferring; means for monitoring the transferring means and for generating signals denoting eventual departures of the transfer of articles from the predetermined pattern; signal processing control means connected with said monitoring means; means for ascertaining the length of spaces between successive articles of the series in said portion of said first path and for transmitting to said control means second signals in response to detection of spaces having a length below a predetermined length; and means for removing from said first path articles following spaces having a length less than said predetermined length in response to processed second signals from said control means.

20. The apparatus of claim 19, wherein said means for removing comprises means for pneumatically expelling articles from said first path.

21. Apparatus for transporting elongated rod-shaped articles of the tobacco processing industry, comprising a fluid-operated first conveyor having means for advancing successive articles of the series of articels longitudinally along a first path; a second conveyor for advancing articles along a second path wherein the articles move transversely of their length; means for transferring successive articles of the series from the first path into the second path in accordance with a predetermined pattern, successive articles of the series being normally separated by spaces during advancement along said first path at least in a first path portion adjacent said means for transferring; means for monitoring the transferring means and for generating signals denoting eventual departures of the transfer of articles from the predetermined pattern; signal processing control means connected with said monitoring means; means for ascertaining the length of spaces between successive articles of the series in said portion of said first path and for transmitting to said control means second signals in response to detection of spaces having a length below a predetermined length; and means for evacuating articles from said first path in response to processed signals generated by at least one of said monitoring means and said length ascertaining means.

22. The apparatus of claim 21, wherein said evacuating means comprises at least one pneumatically operated evacuating device.

* * * * *